United States Patent [19]

Oishi et al.

[11] 4,162,609

[45] Jul. 31, 1979

[54] FILM DISPLAY CLOCK

[75] Inventors: Masaaki Oishi; Itaru Ashida; Tetsuro Suzuki, all of Tokyo, Japan

[73] Assignee: Kabushiki Kaisha Seikosha, Japan

[21] Appl. No.: 818,329

[22] Filed: Jul. 22, 1977

[30] Foreign Application Priority Data

Jul. 23, 1976 [JP] Japan ..... 51-87868

[51] Int. Cl.[2] ..... G04B 19/20; G04C 21/16

[52] U.S. Cl. ..... 58/38 R; 58/16 D; 58/23 D; 58/125 C

[58] Field of Search ..... 58/2, 6 R, 7, 23 D, 58/38 R, 16 R, 16 D, 125 R, 125 C

[56] References Cited

U.S. PATENT DOCUMENTS

| | | | |
|---|---|---|---|
| 2,734,338 | 2/1956 | Uhlig et al. | 58/125 C |
| 2,930,183 | 3/1960 | Nusslé | 58/125 C |
| 2,952,967 | 9/1960 | Nusslé | 58/125 C |
| 3,024,590 | 3/1962 | Wynne | 58/2 |
| 3,807,165 | 4/1974 | Kawada | 58/125 C X |
| 3,979,898 | 9/1976 | Werres | 58/2 |
| 4,005,570 | 2/1977 | Miyamoto et al. | 58/16 D |
| 4,022,015 | 5/1977 | Bailey | 58/2 X |

*Primary Examiner*—Stanley J. Witkowski

*Attorney, Agent, or Firm*—Robert E. Burns; Emmanuel J. Lobato; Bruce L. Adams

[57] ABSTRACT

A film display clock comprises endless display films respectively displaying units of minutes, tens of minutes, and hours. The lengths of the display films are equal.

9 Claims, 2 Drawing Figures

FILM DISPLAY CLOCK

BACKGROUND OF THE INVENTION

The present invention relates to a film display clock. In a conventional film display clock, display films for displaying units-of-minutes, tens-of-minutes and hours have respectively different lengths and structure becomes complex.

SUMMARY OF THE INVENTION

The present invention intends to eliminate the conventional disadvange.

According to a feature of the present invention, there is provided a film display clock comprising, an endless units-of-minutes display film, an endless tens-of-minutes display film, an endless hours display film, drums for driving said display films respectively, interior guide members for said display films, and exterior guide roller for curving said display films, wherein lengths of all said display films are equal.

One object of the present invention is to provide a film display clock which is simple in structure and easy to manufacture.

BRIEF DESCRIPTION OF THE DRAWINGS

The above object, other objects and characteristic features of the present invention will become evident and will be more readily understood from the following description and claims taken in conjunction with the accompanying drawings in which:

DESCRIPTION OF A PREFERRED EMBODIMENT

A preferred embodiment of the invention is shown by way of example in the accompanying drawings.

Figure 1:
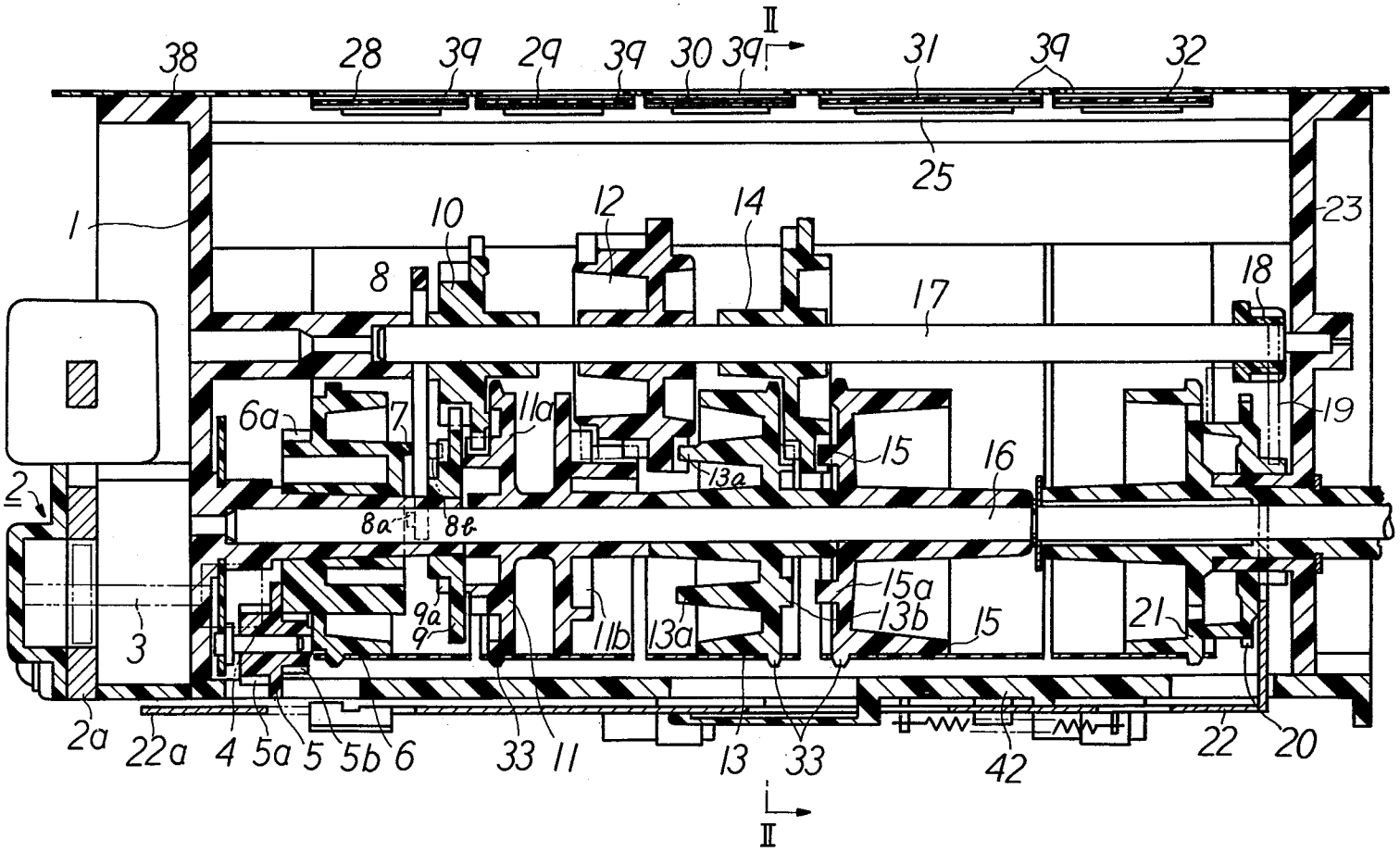
FIG. 1 is a cross section of an essential part of an embodiment according to the present invention.

To a side plate 1, a synchronous motor 2 is secured as seen in FIG. 1. A rotor shaft 3 of the motor penetrates through a hole in the side plate 1 and a motor pinion 4 is connected to its end. The motor pinion 4 meshes with one gear 5*a* of a transmission wheel 5. The other gear 5*b* of the transmission wheel 5 engages with a gear 6*a* of a drum 6 for driving a seconds display film 28.

Figure 2:
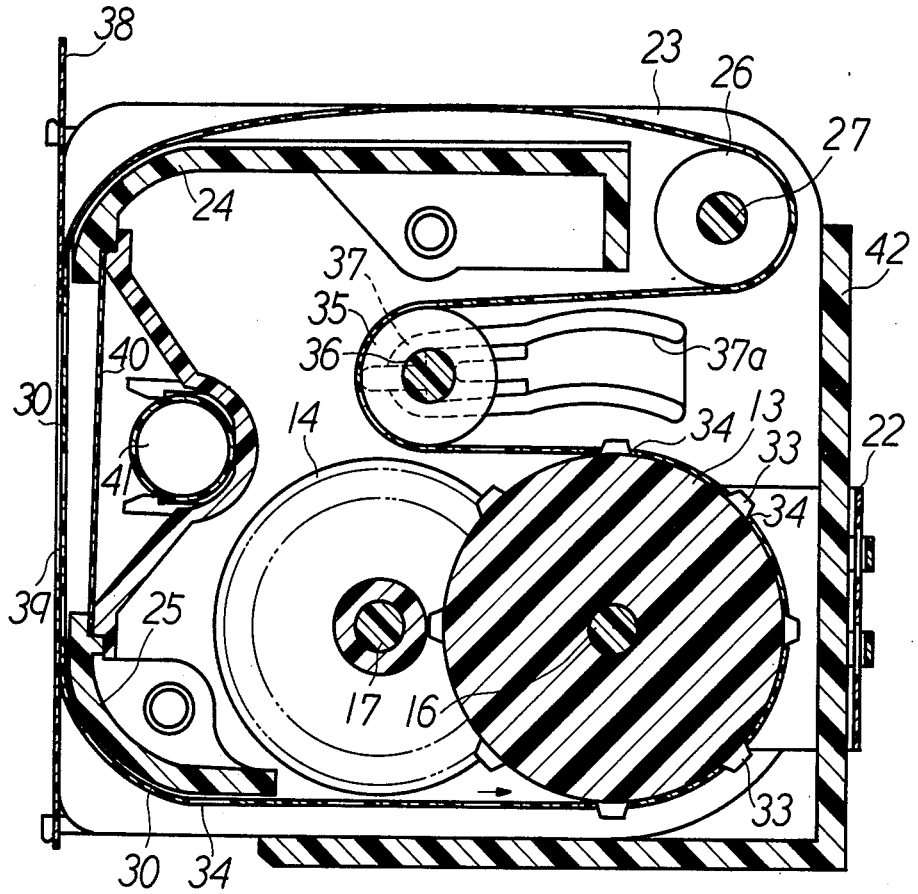
FIG. 2 is an enlarged section along lines II—II in FIG. 1.

The drum 6 is provided with a carryover projection 7 on its other side which is engageable with a projection 8*a* provided on one side of a carryover lever 8. The carryover lever 8 is rockably and slidably supported around the shaft 17. The carryover lever 8 is also provided with a projection 8*b* on its other side which is engageable with a gear wheel 9*a* integral with a carryover wheel 9 and drives it intermittently. A second intermediate wheel 10 engages with the carryover wheel 9 and also engages with a gear wheel 11*a* integral with a drum 11 for driving an units-of-minutes display film 29. The drum 11 is provided with a carryover portion 11*b*, which further engages with a minute intermediate wheel 12. A drum 13 for driving a tens-of-minutes display film 30 engages with the minute intermediate wheel 12 with its drive pins 13*a* - - - . The drum 13 is also provided with a carryover portion 13*b*, which further engages with an hour intermediate wheel 14. A drum 15 for driving an hours display film 31 engages with the hour intermediate wheel 14 with its drive pins 15*a* - - - . The drum 11 for driving the units-of-minutes display film 29 is connected to a shaft 16. The other drums 6, 13 and 15 are rotatably supported by the shaft 16. The hour intermediate wheel 14 is connected to a shaft 17. The second intermediate wheel 10 and the minute intermediate wheel 12 are rotatably supported by the shaft 17. An alarm setting pinion 18 is connected to the shaft 17 and it engages with an alarm setting intermediate wheel 19. The alarm setting intermediate wheel 19 engages with an hour wheel 20. An alarm setting drum 21 is rotatably supported about the shaft 16. An alarm mechanism is composed of the hour wheel 20 and the alarm setting drum 21. At an alarm set time, an end portion of a vibration lever 22 comes to face a stator 2*a* of the motor 2. The shafts 16 and 17 are supported by the side plate 1 and a side plate 23. An interior upper guide member 24 and an interior lower guide member 25 are secured to the side plates 1 and 23 therebetween (see FIG. 2). A shaft 27 of an interior guide roller 26 is supported between the side plates 1 and 23. The seconds display film 28, the units-of-minutes display film 29, the tens-of-minutes display film 30 and the hours display film 31 and the alarm time display film 32 are all endless and equal in length. These films 28 to 32 are driven by the corresponding drums 6, 11, 13, 15 and 21, and follow the guide members 24 and 25 and the guide roller 26 all of which engage the inner face of the films. The each drum is provided with eight teeth 33 - - - on its drum surface. The each display film is provided with twenty-four holes 34 - - - engageable with the teeth 33 of the drum. An exterior guide roller 35 which engages the outer face of the films is rotatable about a shaft 36. Both ends of the shaft 36 are supported by bearing means 37 projected inwards from the side plates 1, 23 and provided with guide slits 37*a*. Each display film is curved by the exterior guide roller 35 to contact the drum with its holes 34 engaging with the teeth 33 to be driven steadily. A mask 38 is provided with windows 39 - - - through which displays of the films behind the mask can be observed. A light scattering film 40 and a light source 41 are provided behind the display films. The side plates 1 and 23 are secured to a base plate 42. The second display film 28 displays every five seconds and bears indications of three cycles of twelve indications "0", "5", "10", "15" - - - "55" at equal distances. The units-of-minutes display film 29 bears one cycle of ten indications from "0" to "9" at equal distances. The tens-of-minutes display film 30 bears two cycles of six indications from "0" to "5" at equal distances. The hours display film 31 bears one cycle of twelve indications from "1" to "12". The alarm time display film 32 bears three cycles of twelve numerals from "1" to "12". In this way, ratio between the cycles of the seconds display film, the units-of-minutes display film, the tens-of-minutes display film, the hours display film and the alarm time display film is set to 3:1:2:1:3. Diameters of the drums 6, 11, 13, 15 an 21 are designed equal. Ratio between the circumference of each drum and the length of each film is set 1:3. Therefore each display film performs one rotation during three rotations of each drum. Accordingly, rotational speed of the drum 6 for seconds display is 1 rpm, rotational speed of the drum 11 for units-of-minutes display is 0,3 rpm, rotational speed of the drum 13 for tens-of-minutes display is 1,5 rpm and rotational speed of the drum 15 for hours display is 0,25 rph. The deceleration gear trains from the motor 2 are so designed to assure such rotational speeds of the drums. During one rotation of the alarm setting drum 21, it drives the alarm time display film 32 by twelve hours. The rotational speed 1 rph of the hour intermediate wheel 14 is transmitted to the hour wheel 20 by the deceleration gear train, and the hour wheel performs two rotations a day.

What is claimed is:

1. A digital film display clock comprising a casing having a horizontally elongate window at its front, a horizontal drum shaft disposed rearwardly of and parallel to the length of said window, a seconds drum, unit minutes drum, tens minute drum and hour drum on said shaft, all of said drums being of equal diameter, a seconds film band, unit minutes film band, tens minute film band and hour film band running on and driven by said drums respectively, all of said film bands being digital and of the same length, guide means for guiding said film bands past said windows to be viewed therethrough, said guide means comprising interior guide means engaging inner faces of said bands and exterior guide means engaging outer faces of said bands, said guide means for all of said bands being aligned with one another, a synchronous motor for driving said seconds drum, first carry-over means actuated by said seconds drum for intermittently driving said unit minutes drum, second carry-over means actuated by said unit minutes drum for intermittently driving said tens minutes drum, and third carry-over means actuated by said tens minutes drum for intermittently driving said hour drum, whereby digits on said bands are successively viewable through said window to present a digital time reading.

2. A digital clock according to claim 1, in which said shaft and drums are disposed in a rear part of said casing and in which said film band guide means comprises forward interior guide means above and below said window at the front of said casing, first coaxial guide rollers on a shaft in a rear part of said casing vertically spaced from said drums and second coaxial guide rollers on a shaft disposed forwardly of said drums and first guide rollers and vertically between said drums and said first guide rollers, said second guide roller engaging the outer faces of said bands.

3. A digital clock according to claim 2, comprising a tubular lamp disposed horizontally rearwardly of said window and vertically between said forward interior guide means.

4. A digital clock according to claim 1, in which said seconds film band bears three cycles of twelve numerals "0", "5", "10". . . "55" at equal distances, said units minutes film band bears one cycle of ten numerals from "0" to "9" at equal distances, said tens minutes film band bears two cycles of six numerals from "0" to "5" at equal distances and said hours film band bears one cycle of twelve numerals from "1" to "12" at equal distances.

5. A digital clock according to claim 1, further comprising an alarm time drum on said shaft, an alarm time film band running on and driven by said alarm time drum and guided by said guide means, an hour wheel coaxial with said alarm time drum, an alarm setting pinion, and an intermediate wheel operatively connecting said alarm setting pinion and said hour wheel.

6. A digital clock according to claim 4, further comprising an alarm time drum on said shaft and an alarm time film band running on and driven by said alarm time drum and guided by said guide means, said alarm time film band bearing three cycles of twelve numerals from "1" to "12".

7. A digital clock according to claim 1, comprising a second shaft parallel to and disposed forwardly of said drum shaft, said carry-over means comprising intermediate wheels on said second shaft.

8. A digital clock according to claim 7, in which said intermediate wheels comprise an hour intermediate wheel fixed to said second shaft and intermediate second and minute wheels rotatable on said second shaft.

9. A digital clock according to claim 8, further comprising an alarm setting pinion fixed on said second shaft, an alarm setting intermediate wheel engaging said pinion, an hour wheel rotatable on said drum shaft and engaging said alarm intermediate wheel, an alarm setting drum rotatable on said drum shaft adjacent said hour wheel, and an alarm time display film band running on and driven by said alarm setting drum and guided by said guide means.

* * * * *